United States Patent [19]

Stoltzman

[11] Patent Number: 4,893,861

[45] Date of Patent: Jan. 16, 1990

[54] DRUM LIFTER RING

[75] Inventor: Michael D. Stoltzman, Lake Forest, Ill.

[73] Assignee: International Precision Components Corporation, Lake Forest, Ill.

[21] Appl. No.: 197,644

[22] Filed: May 23, 1988

[51] Int. Cl.[4] ..... B65D 25/22; B66C 1/18

[52] U.S. Cl. ..... 294/119.2; 220/71; 220/73

[58] Field of Search ..... 294/31.2, 68.1, 68.3, 294/90, 119.2; 220/69–73, 85 R, 85 H, 85 K, 85 P; 414/448, 607

[56] References Cited

U.S. PATENT DOCUMENTS

| | | | |
|---|---|---|---|
| 2,803,372 | 8/1957 | Lee | 220/71 X |
| 2,826,330 | 3/1958 | Imparato | 220/71 |
| 3,387,741 | 6/1968 | Kulaszewski | 220/73 |
| 4,022,345 | 5/1977 | Butz | 220/71 |
| 4,088,239 | 5/1978 | Uhlig | 220/71 X |
| 4,203,526 | 5/1980 | Stoll | 220/71 |
| 4,412,628 | 11/1983 | Whitney | 220/71 |
| 4,626,186 | 12/1986 | Hofstetter | 220/71 X |
| 4,768,673 | 9/1988 | Przytulla | 220/71 |

FOREIGN PATENT DOCUMENTS

| | | | |
|---|---|---|---|
| 2134109 | 1/1972 | German Democratic Rep. | 220/71 |
| 702798 | 1/1954 | United Kingdom | 220/71 |

*Primary Examiner*—Johnny D. Cherry

*Attorney, Agent, or Firm*—Wood, Dalton, Phillips, Mason & Rowe

[57] ABSTRACT

A drum lifter ring formed as a one-piece molded synthetic resin ring having a plurality of rows of radially outwardly opening recesses in a midportion thereof, a rigid top wall projecting radially outwardly to beyond the outer surface of the midportion, and a rigid bottom wall projecting radially inwardly beyond the inner surface of the midportion. The bottom wall is provided with a plurality of downwardly opening recesses. The top wall defines a downwardly opening annular recess adjacent the outer surface of the ring midportion. In the illustrated embodiment, the radially outwardly opening recesses in the midportion are provided in a plurality of vertically spaced rows, with the recesses of the respective rows vertically aligned.

15 Claims, 1 Drawing Sheet

FIG. 1
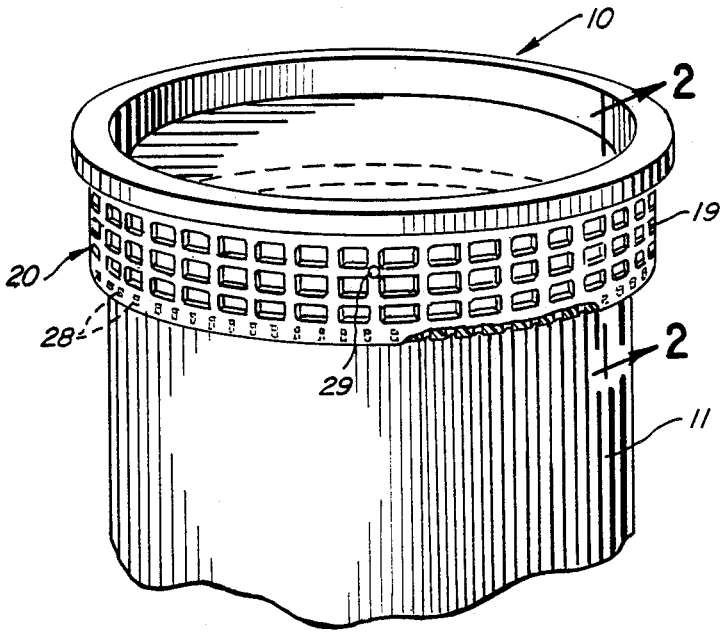
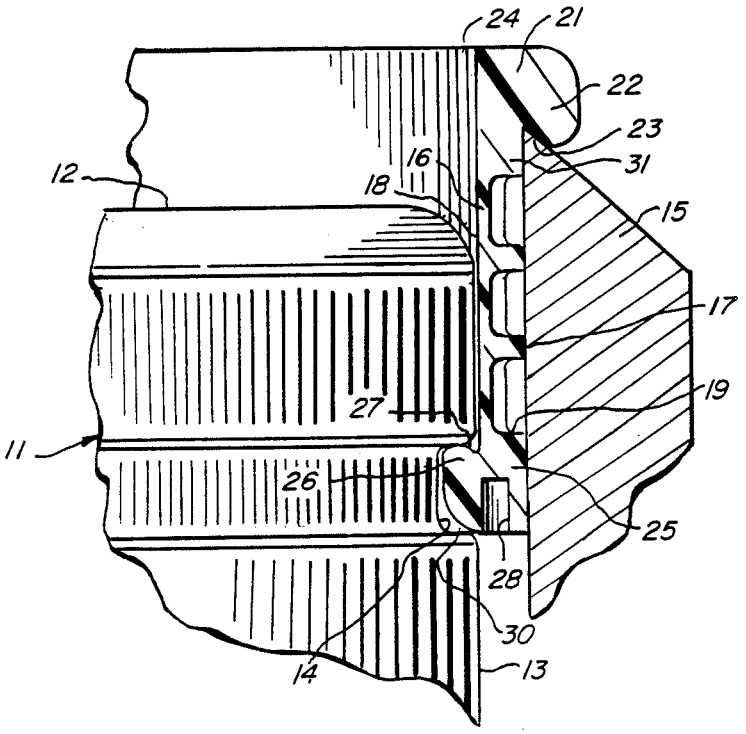
FIG. 2

DRUM LIFTER RING

TECHNICAL FIELD

This invention relates to material handling devices and in particular to a lifter ring adapted to be fixedly mounted to the upper end of material handling drum for use in handling the drum as by a lifting means of a conventional lift truck.

BACKGROUND ART

In one form of material handling drum, the drum includes a top wall and a cylindrical sidewall. A radially outwardly opening annular groove is provided in the sidewall subjacent the top wall. The groove is adapted to receive a lift ring. The lift ring is arranged to be engaged by the lifting hook provided on a lift truck lifting means so as to permit handling of the drum with the lift truck.

The present forms of such lift rings have not proven completely satisfactory in that they are relatively expensive and heavy. There has long been a need for a lightweight, inexpensive lift ring capable of permanent installation on such drums carrying relatively heavy materials and adapted for facilitated handling of the drum by a conventional lift truck lifting means.

DISCLOSURE OF INVENTION

The present invention comprehends an improved drum lifter ring adapted for use with a conventional material handling drum, which is relatively inexpensive, lightweight and yet which provides for long, trouble-free life in the handling of the drum.

More specifically, the invention comprehends the provision of such a one-piece drum lifter ring formed of molded synthetic resin and having an annular thin walled midportion defining a radially outer surface, a radially inner surface, and a plurality of recesses spaced circumferentially therein, and opening radially outwardly through the outer surface, an annular rigid top wall having a radially outer portion projecting outwardly beyond the midportion outer surface, and defining a downwardly opening annular recess for receiving an upwardly extending lifting hook, and an annular rigid bottom wall having a radially inner portion projecting inwardly beyond the radially inner surface of the midportion to be fixedly received in an annular groove of a drum to which the lifter ring is to be mounted, and at least one downwardly opening recess in the bottom wall.

In the illustrated embodiment, the plurality of recesses in the midportion includes vertically spaced annular rows of circumferentially spaced recesses.

In the illustrated embodiment, the recesses are generally rectangular in transverse cross section.

The recesses of the different rows may be vertically aligned.

In the illustrated embodiment, the recesses of the midportion have a depth at least one-half the thickness thereof.

The top wall may have a thickness of at least approximately twice that of the midportion, and the bottom wall may have a thickness approximately twice that of the midportion.

The midportion defines an inner surface and the bottom wall inner portion defines an upwardly opening recess adjacent the inner surface.

The bottom wall defines a tapered, radially inner lower guide surface for facilitating installation of the lifting ring on the drum.

In the illustrated embodiment, the guide surface comprises a rounded surface.

The inner surface of the midportion in the illustrated embodiment, is right circularly cylindrical.

In the illustrated embodiment, the downwardly opening recess in the top wall is disposed adjacent the outer surface of the midportion.

The top wall radially inner surface is contiguous with the radially inner surface of the midportion, in the illustrated embodiment.

The midportion may define an annular upper portion adjacent the top wall and an annular lower portion adjacent the bottom wall, each of which is free of recesses.

Thus, the drum lifter ring of the present invention is extremely simple and economical of construction, while yet providing the highly desirable features discussed above.

BRIEF DESCRIPTION OF THE DRAWING

Other features and advantages of the invention will be apparent from the following description taken in connection with the accompanying drawing wherein:

FIG. 1 is a fragmentary perspective view of a drum lifter ring embodying the invention installed on material handling drum, with a portion of the lifter ring being broken away to facilitate illustration of the construction thereof; and FIG. 2 is a fragmentary enlarged vertical section taken substantially along the line 2—2 and illustrating the engagement of a lift truck lifting means with the drum lifter ring in the use of the ring.

BEST MODE FOR CARRYING OUT THE INVENTION

In the illustrative embodiment of the invention as disclosed in the drawing, a drum lifter ring generally designated 10 is shown to comprise a one-piece ring formed of a suitable material, such as molded synthetic resin. The ring is adapted to be mounted to a conventional material handling drum 11 having a top wall 12 and a right circularly cylindrical side wall 13. The sidewall is provided with a radially outwardly opening annular recess 14 spaced below the top wall 12, as shown in FIG. 2.

Lifter ring 10 is adapted to be installed on the upper end of the drum by downward movement thereof coaxially o the sidewall 13 to the installed disposition shown in the drawing. Once installed on the upper end of the drum, the lifter ring serves as means for engagement by a conventional lift truck lifting means, such as lifting means 15 illustrated in FIG. 2, for lifting and transporting the drum as desired. The ring is adapted to be fixedly secured to the top of the drum for long, trouble-free handling thereof. In one conventional form, the drum is formed of fiberboard.

The drum lifter ring includes a midportion 16, as best seen in FIG. 2. The midportion comprises a thin-walled portion of the ring and defines an outer surface 17, an inner surface 18, and a plurality of recesses 19 opening radially outwardly through the outer surface 17 and being spaced circumferentially of the ring. As seen in FIG. 1, the recesses may be provided in a plurality of vertically spaced rows 20, with the recesses of the respective rows vertically aligned.

The lifter ring further includes a rigid top wall 21 having a radially outer portion 22 projecting outwardly beyond the outer surface 17 of the midportion, as best seen in FIG. 2.

The top wall further defines a downwardly opening annular recess 23 adapted to receive the upwardly extending lifting hook 15, as shown.

The top wall further defines radially inner surface 24 which, as shown in FIG. 2, is contiguous with the inner surface 18 of the midportion.

The lifting ring further includes an annular rigid bottom wall generally designated 25, having a radially inner portion 26 projecting inwardly beyond the radially inner surface 18 of the midportion and adapted to be fixedly received in the annular groove 14 of the drum, as shown.

Bottom wall 25 further defines an annular, upwardly opening recess 27 adjacent the inner surface 18 of midportion 16.

The bottom wall further defines at least one downwardly opening recess 28 and, in the illustrated embodiment, a plurality of such downwardly opening recesses 28 are provided in circumferentially spaced relationship, as shown in FIG. 1.

In the illustrated embodiment, recesses 19 are generally rectangular in transverse cross section, as shown in FIG. 1. Recesses 28, illustratively, are right circularly cylindrical. One or more through openings 29 may be provided in the midportion 16 for draining water which may collect on the top wall where the drum is stored in an outdoor environment.

Recesses 19, as seen in FIG. 2, have a depth of at least approximately one-half the thickness of the midportion. Top wall 21, as illustrated, has a thickness of at least approximately twice that of the midportion, and bottom wall 25, as illustrated, has a thickness at least approximately twice that of the midportion.

Bottom wall 25 further defines a downwardly flared guide surface 30 for facilitating downward movement of the lifter ring past top wall 12 onto the cylindrical sidewall 13 of the drum. As shown in FIG. 2, in the illustrated embodiment, guide surface 30 is rounded.

As shown in FIG. 2, each of inner surface 18 of midportion 16 and inner surface 24 of top wall 21 is right circularly cylindrical.

An upper portion 31 of the midportion 16 is free of outwardly opening recesses, and a lower portion 32 of the midportion is similarly free of outwardly opening recesses, as seen in FIGS. 1 and 2.

Outer surface 17 of the midportion is generally right circularly cylindrical.

The lifter ring 10 has been found to provide an improved, positive fixed lifting ring when associated with the conventional annularly grooved drum, as discussed above. The lifter ring is extremely simple, economical of construction, and low in cost, while yet providing a positive lifting means for such drums.

The foregoing disclosure of specific embodiments is illustrative of the broad inventive concepts comprehended by the invention.

I claim:

1. A drum lifter ring for use in lifting a drum by means of an upwardly directed lifting hook, the drum having a top wall and a sidewall provided with an annular, outwardly opening groove spaced below the top wall, said lifter ring comprising a one-piece ring of moulded synthetic resin having an annular thin-walled midportion defining a radially outer surface, a radially inner surface, and a plurality of recesses spaced circumferentially therein, and opening radially outwardly through said outer surface, an annular rigid top wall having a radially outer portion projecting outwardly beyond said midportion outer surface and defining a downwardly opening annular recess for receiving an upwardly extending lifting hook, and an annular rigid bottom wall having a radially inner portion projecting inwardly beyond said radially inner surface of the midportion to be fixedly received in an annular groove of a drum to which the lifter ring is to be mounted, a radially outer portion, and at least one downwardly opening recess in said bottom wall disposed between said radially inner portion and said radially outer portion.

2. The drum lifter ring of claim 1 wherein said plurality of outwardly opening recesses in said midportion includes vertically spaced annular rows of circumferentially spaced recesses.

3. The drum lifter ring of claim 1 wherein said plurality of outwardly opening recesses are generally rectangular in transverse cross section.

4. The drum lifter ring of claim 1 wherein said plurality of outwardly opening recesses in said midportion includes vertically spaced annular rows of circumferentially spaced recesses, the recesses of the different rows comprising vertically aligned recesses.

5. The drum lifter ring of claim 1 wherein said recesses in said midportion of the ring have a depth at least one-half the thickness of said midportion.

6. The drum lifter ring of claim 1 wherein said top wall has a thickness at least approximately twice that of said midportion.

7. The drum lifter ring of claim 1 wherein said bottom wall has a thickness at least approximately twice that of said midportion.

8. The drum lifter ring of claim 1 wherein said bottom wall inner portion defines an upwardly opening recess adjacent said inner surface of the midportion.

9. The drum lifter ring of claim 1 wherein said bottom wall defines a tapered radially inner lower guide surface.

10. The drum lifter ring of claim 1 wherein said bottom wall defines a rounded radially inner lower guide surface.

11. The drum lifter ring, of claim 1 wherein said midportion defines a right circularly cylindrical inner surface.

12. The drum lifter ring of claim 1 wherein said downwardly opening recess in said top wall is disposed adjacent said outer surface of the midportion.

13. The drum lifter ring of claim 1 wherein said top wall defines a radially inner surface contiguous with said radially inner surface of the midportion.

14. The drum lifter ring of claim 1 wherein said midportion defines an annular upper portion adjacent said top wall free of recesses.

15. The drum lifter ring of claim 1 wherein said midportion defines an annular lower portion adjacent said bottom wall free of said recesses.

* * * * *

UNITED STATES PATENT AND TRADEMARK OFFICE

CERTIFICATE OF CORRECTION

PATENT NO. : 4,893,861

DATED : January 16, 1990

INVENTOR(S) : Michael D. Stolzman

It is certified that error appears in the above-identified patent and that said Letters Patent is hereby corrected as shown below:

On the title page:

The correct spelling of the inventor's name is:

MICHAEL D. STOLZMAN

Signed and Sealed this

Fifteenth Day of January, 1991

*Attest:*

HARRY F. MANBECK, JR.

*Attesting Officer*

*Commissioner of Patents and Trademarks*